US007382388B2

(12) United States Patent
Naito

(10) Patent No.: US 7,382,388 B2
(45) Date of Patent: Jun. 3, 2008

(54) THERMAL PRINTER

(75) Inventor: Tadahiro Naito, Kadoma (JP)

(73) Assignee: Funai Electric Co., Ltd., Osaka (JP)

( * ) Notice: Subject to any disclaimer, the term of this patent is extended or adjusted under 35 U.S.C. 154(b) by 384 days.

(21) Appl. No.: 11/327,420

(22) Filed: Jan. 9, 2006

(65) Prior Publication Data

US 2006/0158507 A1 Jul. 20, 2006

(30) Foreign Application Priority Data

Jan. 14, 2005 (JP) ..... 2005-007438

(51) Int. Cl.
*B41J 2/38* (2006.01)

(52) U.S. Cl. ..... 347/186; 347/194

(58) Field of Classification Search ..... 347/185, 347/186, 188, 194; 400/120.08, 120.09, 400/120.14

See application file for complete search history.

(56) References Cited

U.S. PATENT DOCUMENTS 4,955,736 A * 9/1990 Iwata et al. ..... 400/120.08
6,670,976 B2 * 12/2003 Watanabe ..... 347/186

FOREIGN PATENT DOCUMENTS

JP 55-164177 * 12/1980
JP 61-078671 * 4/1986
JP 61-239966 10/1986
JP 62-164568 * 7/1987
JP 63-134260 * 6/1988
JP 63-166558 7/1988
JP 01-206070 8/1989
JP 02-269063 11/1990
JP 03-130172 6/1991
JP 03-147859 A 6/1991
JP 03-218857 9/1991
JP 04-18372 A 1/1992
JP 04-319449 11/1992
JP 04-357050 12/1992
JP 05-024268 2/1993
JP 06-9955 U 2/1994
JP 11-058807 3/1999
JP 2001-260408 9/2001

* cited by examiner

*Primary Examiner*—Huan H Tran
(74) *Attorney, Agent, or Firm*—Global IP Counselors, LLP

(57) ABSTRACT

A thermal printer performs printing on a paper based on printing density data input. The thermal printer includes a thermal head having at least one heating element; a temperature detector which detects a temperature of the thermal head; and a control part which is connected to the thermal head and the temperature detector, receives the printing density data, and controls an amount of energy to be supplied to the heating element based on the printing density data. The control part stores therein a printing density-energy supply amount table which sets forth an amount of energy to be supplied to the heating element to perform printing with certain printing densities at certain head temperatures. The printing density-energy supply amount table sets forth that the amount of energy to be supplied is greater than zero at the printing density of zero if the head temperature is lower than a predetermined temperature.

6 Claims, 7 Drawing Sheets

| Printing Density | Head Temperature | | | | |
|---|---|---|---|---|---|
| | 29°C or less | 30°C | 31°C | 32°C | 33°C |
| 0 | 22 | 20 | 19 | 0 | 0 |
| 1 | 40 | 40 | 39 | 38 | 37 |
| 2 | 41 | 41 | 40 | 39 | 38 |
| 3 | 42 | 42 | 41 | 40 | 39 |
| 4 | 43 | 43 | 42 | 41 | 40 |
| 5 | 48 | 48 | 47 | 46 | 45 |
| 6 | 50 | 50 | 49 | 48 | 47 |

| Printing Density | Head Temperature 30°C | 31°C | 32°C | 33°C |
|---|---|---|---|---|
| 0 | 0 | 0 | 0 | 0 |
| 1 | 40 | 39 | 38 | 37 |
| 2 | 41 | 40 | 39 | 38 |
| 3 | 42 | 41 | 40 | 39 |
| 4 | 43 | 42 | 41 | 40 |
| 5 | 48 | 47 | 46 | 45 |
| 6 | 50 | 49 | 48 | 47 |

PRIOR ART

THERMAL PRINTER

BACKGROUND OF THE INVENTION

1. Field of the Invention

The present invention relates to a thermal printer having a thermal head.

2. Background Information

In thermal printers, the printing density is generally known to become denser as the temperature of the heating elements of the thermal head increases. Furthermore, the temperature of the heating elements is controlled by controlling the time during which electric power is transmitted to these heating elements. Moreover, each of the heating elements corresponds to a dot of the printed image, and the time during which the electric power is transmitted to these heating elements is controlled for each heating element. These times are set forth beforehand in the form of tables 121P as shown in FIG. 6. In the time table 121P used in a known thermal printer, electric power is not provided to the heating elements that correspond to dots having zero (0) printing density, i.e., dots that are not to perform the printing (printing blank).

Here, FIG. 7 shows a diagram used to illustrate the problems encountered in known thermal heads. FIGS. 7(*a*) and (*b*) show respective examples of black and white printed images. Furthermore, in FIG. 7, the direction of printing is indicated by an arrow for the purposes of illustration.

In this thermal printer, transmission of power is stopped to the heating elements of which the printing density is 0. Accordingly, in the case of images in which there is a continuous blank portion (i.e., a continuous non-printed state) as shown, for example, in FIG. 7, the time period during which no power is provided to the heating elements continues for a considerable amount of time. During such period, the head temperature decreases. As a result, when black portions are to be printed subsequently, there are cases where the head temperature is insufficient so that the desired density cannot be obtained.

In view of the above, it will be apparent to those skilled in the art from this disclosure that there exists a need for an improved thermal printer that overcomes the problems described above. This invention addresses this need in the art as well as other needs, which will become apparent to those skilled in the art from this disclosure.

SUMMARY OF THE INVENTION

It is an object of the present invention to provide a thermal printer that can improve the printing quality by reducing the occurrences of a decrease in the head temperature.

The first aspect of the present invention provides a thermal printer which is adapted to perform printing on a paper based on printing density data input. The thermal printer includes a thermal head having at least one heating element; a temperature detector which is configured to detect a temperature of the thermal head; and a control part which is operatively connected to the thermal head and the temperature detector and configured to receive the printing density data and control an amount of energy to be supplied to the heating element based on the printing density data. The control part stores therein a printing density-energy supply amount table which sets forth an amount of energy to be supplied to the heating element to perform printing with certain printing densities at certain head temperatures. The printing density-energy supply amount table sets forth that the amount of energy to be supplied is greater than zero at the printing density of zero if the head temperature is lower than a predetermined temperature, while the energy to be supplied to the heating element is zero at the printing density of zero if the head temperature is higher than the predetermined temperature.

In this construction, in cases in which the head temperature is low, the energy to be supplied at the time of zero printing density (i.e., non-printing) is set forth as greater than zero but not enough to allow the actual printing to occur. Accordingly, occurrences of a decrease in the head temperature can be reduced. Consequently, for example, the desired printing density can be obtained even immediately after a long period during which the printing density has been zero, so that the printing quality can be improved.

In addition, in cases in which the head temperature is higher than the predetermined temperature, the energy is not supplied to the heating elements that correspond to zero printing density during the printing operation. Accordingly, as compared to, for example, a system in which powering is always performed in the case of zero printing density regardless of the head temperature, the excessive accumulation of heat in the thermal head can be prevented. Consequently, unnecessary coloring can be prevented, so that the printing quality can be improved.

Moreover, the abovementioned control is performed during the printing operation. Accordingly, for example, as compared to a system in which the electric power is supplied to the heating element for the purpose of preventing a decrease in the head temperature separately from the printing operation, there is no increase in the overall printing time.

The second aspect of the present invention is the thermal printer of the first aspect, in which the energy to be supplied to the heating element at the printing density of zero increases as the head temperature decreases when the head temperature is lower than the predetermined temperature.

Accordingly, even in cases in which the decrease in the head temperature is large, the head temperature can quickly be raised. Furthermore, in cases in which the decrease in the head temperature is small, the excessive accumulation of heat in the thermal head can be prevented.

The third aspect of the present invention is the thermal printer of the first aspect, in which the printing density-energy supply amount table sets forth power transmission times during which electric power should be supplied to the heating element to perform printing with certain printing densities at certain head temperatures, and the control part is configured to control the amount of energy to be supplied to the heating element by controlling the power transmission time to the heating element.

In this construction, in cases in which the head temperature is low, the power transmission time that corresponds to zero printing density (i.e., non-printing) is set forth as a time that is longer than zero but too short to allow the actual printing to occur. Accordingly, an occurrence of decrease in the head temperature can be reduced. Consequently, for example, the desired printing density can be obtained even immediately after a long period during which the printing density has been zero, so that the printing quality can be improved.

In addition, in cases in which the head temperature is higher than the predetermined temperature, the power transmission time that corresponds to zero printing density is set forth as 0. Accordingly, for example, as compared to a system in which the electric power is constantly supplied to the in the case of zero printing density regardless of the head temperature, excessive heat accumulation in the thermal head can be prevented. Consequently, unnecessary coloring can be prevented, so that the printing quality can be improved.

Moreover, the abovementioned power transmission time concerns the power transmission time during the printing operation. Accordingly, for example, as compared to a system in which powering for the purpose of preventing a decrease in the head temperature is performed separately from the printing operation, there is no increase in the overall printing time.

The fourth aspect of the present invention is the thermal printer of the first aspect, in which the thermal head has a plurality of heating elements, and the control part is configured to control the amount of energy to be supplied to each of the heating elements based on the printing density data.

The fifth aspect of the present invention is the thermal printer of the first aspect, in which the plurality of heating elements correspond to a plurality of colors to be printed.

Thus, for example, the desired printing density can be obtained even immediately after a long period of zero printing density, so that degradation of the printing quality can be reduced. Furthermore, for example, as compared to a system in which the energy is always supplied when the printing density is zero regardless of the head temperature, unnecessary coloring can be prevented. Thus, the printing quality can be improved. Furthermore, in the present invention, as compared to, for example, a system in which powering for the purpose of preventing a decrease in the head temperature is performed separately from the printing operation, there is no increase in the overall printing time.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
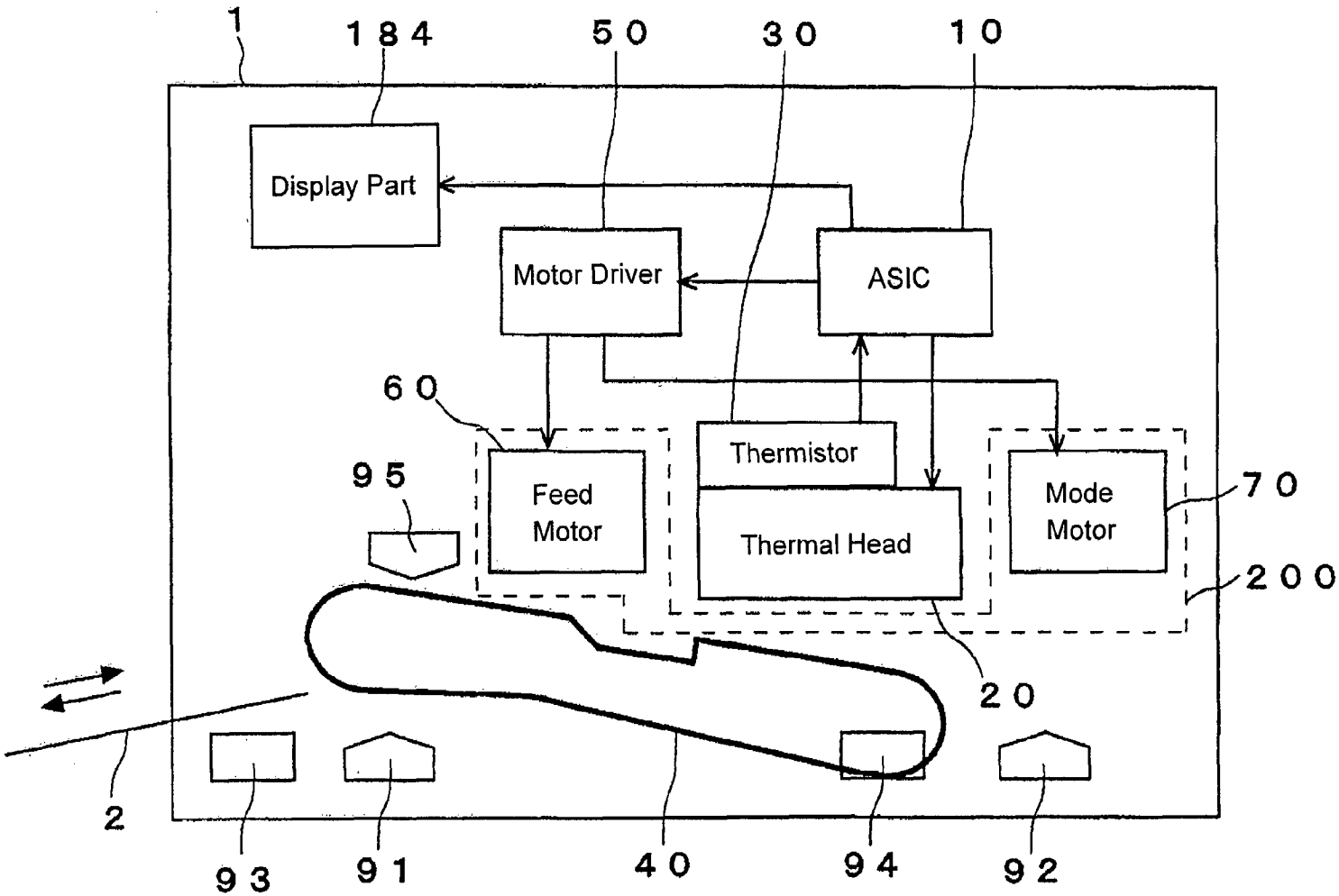
FIG. 1 is a schematic block diagram illustrating a thermal printer in accordance with one embodiment of the present invention.
Figure 2:
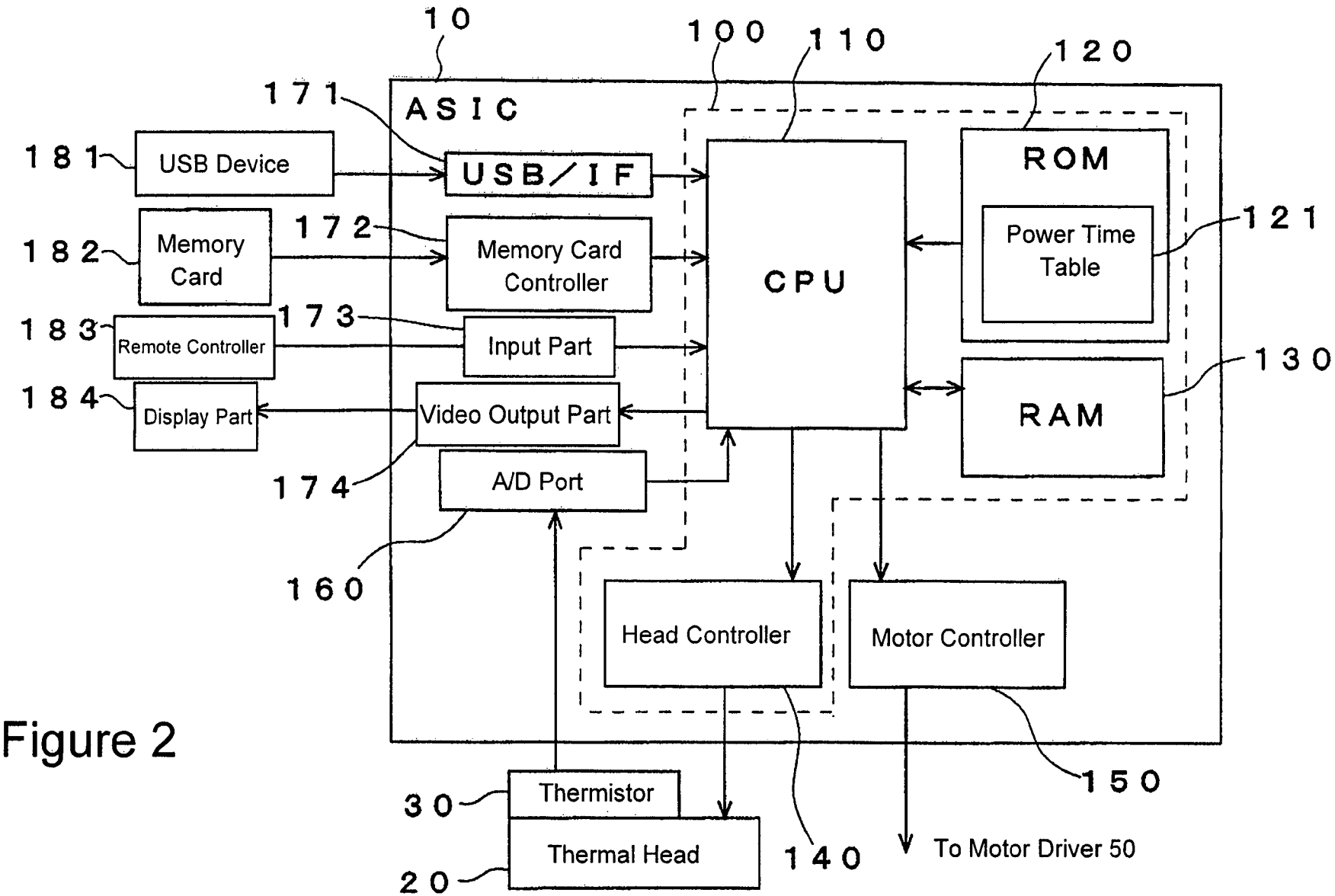
FIG. 2 is a schematic block diagram illustrating the thermal printer in accordance with the embodiment of the present invention.
Figure 3:
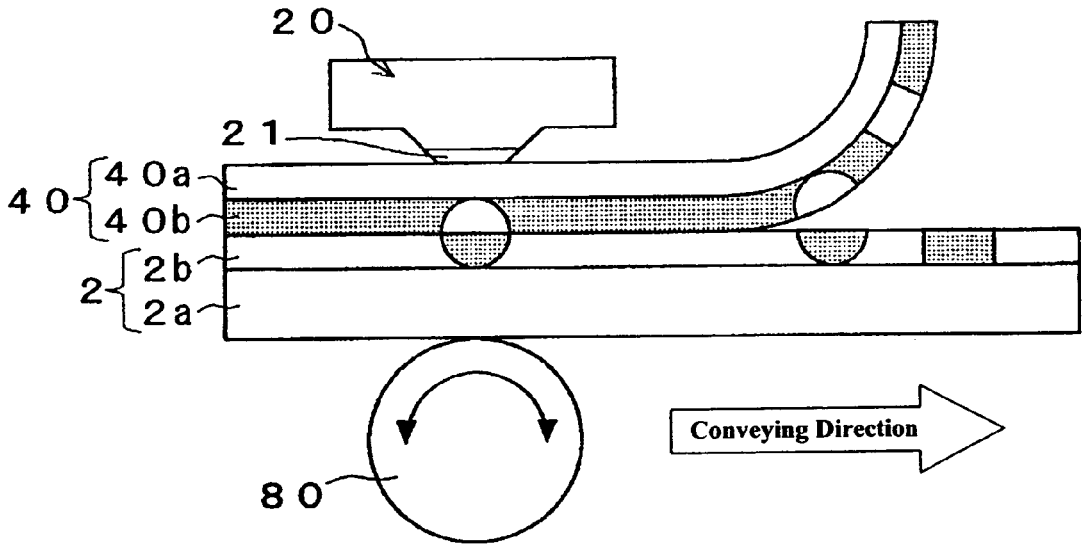
FIG. 3 is a schematic diagram illustrating the printing system in the thermal printer in accordance with the embodiment of the present invention.

FIGS. 1 and 2 are block diagrams illustrating a thermal printer 1 in accordance with one embodiment of the present invention. Furthermore, FIG. 2 is a diagram illustrating the ASIC (application specific integrated circuit) 10 in FIG. 1. Moreover, FIG. 3 shows a schematic diagram illustrating the printing system in the thermal printer 1.

The thermal printer 1 is a so-called sublimation type printer. As is shown in FIG. 1, the thermal printer 1 is constructed so that this printer includes an ASIC 10, a thermal head 20, a thermistor 30, an ink ribbon 40, a motor driver 50, a feed motor 60, a mode motor 70, paper sensors 91 and 92, a tray sensor 93, a cartridge sensor 94, a marker sensor 95, and a display part 184 formed of, for example, a liquid crystal display or the like. The thermal printer 1 also includes a platen roller 80 (see FIG. 3), although this is omitted from FIG. 1 in order to simplify the figure.

Furthermore, as is shown in FIG. 2, the ASIC 10 is constructed so that this circuit includes a CPU (central processing unit) (or CPU core) 110, a ROM (read-only memory) 120, a RAM (random-access memory) 130, a head controller 140, a motor controller 150, an A/D port 160, a USB (universal serial bus) interface (hereafter called a "USB/IF") 171, a memory card controller 172, an input part 173, and a video output part 174. The CPU 110 is operatively connected to the RAM 130, the head controller 140, the motor controller 150, and the video output part 174 so as to be able to selectively control any of these components according to the control programs stored in the ROM 120. Furthermore, the CPU 110 is also operatively connected to the ROM 120, the A/D port 160, the USB/IF 171, the memory card controller 172, and the input part 173 so as to be able to retrieve data selectively from any of these components according to the control programs stored in the ROM 120.

As is shown in FIG. 1, the ASIC 10 controls the feed motor 60 and mode motor 70 via the motor driver 50. In this case, in the ASIC 10, as is shown in FIG. 2, the motor controller 150 controls the motor driver 50 in accordance with specified instructions from the CPU 110. Here, however, the control of the motor driver 50 by the motor controller 150 can be performed independently from and in parallel with other controls by the CPU 110. The feed motor 60 is a motor that is used to feed and discharge the image receiving paper 2 (see FIG. 3) to and from the thermal head 20, and the mode motor 70 is a motor that is used to control the orientation of the thermal head 20, or more precisely, to control vertical movement (pressing and separation) of the thermal head 20 with respect to the image receiving paper 2 and the platen roller 80.

As is shown in FIG. 3, the thermal head 20 has heating resistors or heating elements 21 on the side facing the platen roller 80. In the thermal head 20, a plurality of heating elements 21 are disposed in the form of a line in the direction perpendicular to the paper plane of FIG. 3. Furthermore, each of the heating elements corresponds to a dot in the printed image.

The printing system used in the thermal printer 1 will be described with reference to FIG. 3. As is shown in FIG. 3, respective dye ink layers 40*b* of yellow (Y), magenta (M) and cyan (C) are disposed on a base film 40*a* in the ink ribbon 40, so that color printing can be accomplished by performing the printing in each of these respective colors. Furthermore, the image receiving paper 2 is formed by disposing a receiving layer 2*b* on the surface of a substrate 2*a*. In this sublimation type thermal printer 1, the ink ribbon 40 and the image receiving paper 2 are set between the thermal head 20 and the platen roller 80 so that the dye ink layers 40*b* and the receiving layer 2*b* contact each other, and so that the ink ribbon 40 is on the side closer to the thermal head 20. Then, coloring is accomplished by melting the ink of the dye ink layers 40*b* with the heat of the heating elements 21 so that the ink is transferred to the receiving layer 2*b* of the image receiving paper 2, thus causing printing to be performed. In this case, the transfer of the ink and the amount of such transfer, i.e., the printing density and printing gradation, are controlled with the temperature of the heating elements 21. The printing density increases with an increase in this temperature.

In such a printing system, the temperature control of the abovementioned heating elements 21 is basically accomplished by the ASIC 10 controlling the time during which the electric power is transmitted to each of the heating elements 21 based on the printing density data for the dots that correspond to the heating elements 21. Such printing density data are inputted to the CPU 110 from a USB device (such as camera) 181 via the USB/IF 171, or from a memory card 182 via the memory card controller 172. More specifically, as is shown in FIG. 2, the head controller 140, which receives instructions from the CPU 110, controls the power transmission time of the respective heating elements 21 based on the printing density data. The control of the power transmission time by the head controller 140 can be performed independently from and in parallel with other controls by the CPU 110. The control of the power transmission time will be described in detail later.

Furthermore, as is shown in FIGS. 1 and 2, the thermistor 30 is installed in the thermal head 20 as a temperature detector for detecting the temperature of the thermal head 20. Signals from this thermistor 30 are transmitted to the CPU 110 via the A/D port 160 of the ASIC 10. For example, the temperature of the thermal head 20 (hereafter referred to as the "head temperature") is detected at the time when the printing data is read, or at periodic intervals.

The paper sensors 91 and 92 monitor the conveyance of the image receiving paper 2. The cartridge sensor 94 monitors the mounting of the cartridge (not shown in the figures) in which the ink ribbon 40 is accommodated, and the marker sensor 95 detects markers that are formed on the ink ribbon 40 for positioning purposes. Furthermore, although this is not shown in FIG. 1, the signals from the respective sensors 91 through 95 are processed by the ASIC 10.

Furthermore, as is shown in FIG. 2, the CPU 110 of the ASIC 10 receives printing data and the like from a USB device 181 via a USB/IF 171, receives printing data and the like from a memory card 182 via a memory card controller 172, and receives remote control signals and the like from a remote controller 183 via an input part 173. Moreover, the CPU 110 displays various types of information on the display part 184 via a video output part 174.

Various types of processing (described above and described later) performed by the CPU 110 are performed in accordance with programs (not shown in the figures) stored in the ROM 120. A power transmission time table 121 (described below) is stored in the ROM 120, and the CPU 110 controls the thermal head 20 by using this power transmission time table 121. Furthermore, the CPU 110 controls the writing and reading of printing data and the like into and from the RAM 130.

Figure 4:
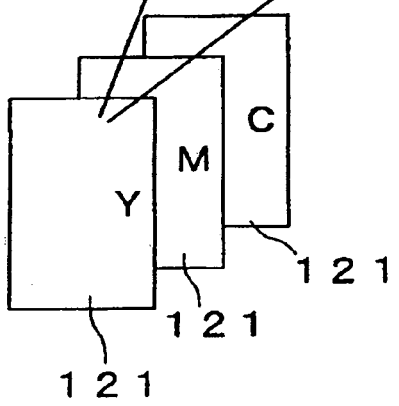
FIG. 4 is a schematic diagram illustrating the power transmission time table in the thermal printer in accordance with the embodiment of the present invention.

FIG. 4 shows a schematic diagram illustrating the power transmission time table 121 stored in the thermal printer 1. In the thermal printer 1, the power transmission time (during printing) of the heating elements 21 of the thermal head 20 is set forth beforehand in terms of both the head temperature and the printing density data for the dots that correspond to the heating elements 21. These power transmission time data are stored in the ROM 120 as a power transmission time table 121 (an example of the printing density-energy supply amount table).

Furthermore, the head temperature is detected by the thermistor 30 as described above, and printing density data is obtained by reading printing data from the RAM 130, or by processing such printing data. For example, in FIG. 4, if the head temperature is 33° C. in cases in which the printing is to be performed with a printing density of "3," the power transmission time of the heating elements 21 that correspond to dots with the printing density of "3" is determined as 39 milliseconds. In this embodiment, the power transmission time table 121 is prepared for printing of each of the colors of yellow (Y), magenta (M), and cyan (C).

Hereinafter, "a heating element 21 that corresponds to a dot having a printing density of '3'" will be also be expressed as "a heating element 21 that corresponds to a printing density of '3'" and "a power transmission time of a heating element 21 that corresponds to a dot having a printing density of '3'" will also be expressed as "a power transmission time that corresponds to a printing density of '3'."

Here, the CPU 110, the ROM 120 (in which the power transmission time table 121 is stored), the RAM 130 (in which printing density data are stored), and the head controller 140 are collectively referred to as the "control part 100." The control part 100 controls the power transmission time of the heating elements 21 while referring to the power transmission time table 121, and the temperature of the heating elements 21 is controlled by such control of the power transmission time.

In particular, in the power transmission time table 121 shown in FIG. 4, the power transmission time is set forth as a value other than "0 (zero)" when the head temperature is low, in other words lower than 31° C., even though the printing density is "0 (zero)," in other words no printing is to be performed. On the other hand, if the head temperature is not low, in other words higher than 31° C., the power transmission time is set forth as 0 at the printing density of "0 (zero)." However, the power transmission time when the head temperature is low is set so that the temperature of the heating elements 21 is too low to perform printing, i.e., too low to melt the ink of the dye ink layers 40*b* (see FIG. 3). Additionally, as seen in FIG. 4, the power transmission times at the zero printing density are set to increase as the head temperature decreases. However, the power transmission time at the zero printing density is always set to be too short for the printing to be actually performed.

In the example shown in FIG. 4, the head temperature of equal to or less than 31° C. is considered to be a low temperature, and the power transmission times in the cases where the head temperature is 31° C., 30° C. and 29° C. are respectively set forth as 19 milliseconds, 20 milliseconds and 22 milliseconds in this embodiment. On the other hand, the power transmission time in cases in which the head temperature is 32° C. or greater is set forth as 0 (i.e., power transmission is not performed) in this embodiment.

Instead of the power transmission table 121 shown in FIG. 4, the thermal printer of the present invention may use a power transmission table in which the power transmission time decreases gradually as the head temperature increases, with the power transmission time approaching zero or substantially zero at around a threshold temperature of 20° C.-30° C. or between 10° C. and 60° C.

In the thermal head 1, by using such power transmission time table 121, if the head temperature is low, the electric power is transmitted to the heating elements 21 that correspond to the printing density of "0" for a period of time short enough not to allow the printing to be actually performed by those heating elements 21 during the printing operation. On the other hand, if the head temperature is not low, the electric power is not transmitted to the heating elements 21 that correspond to the printing density of "0" during the printing operation. In this case, furthermore, the control 100 transmits the electric power to the heating elements 21 having the printing density other than "0" for a period of time specified by the power transmission time table 121.

In other words, in cases in which the head temperature is low, dummy pulses are applied to the heating elements 21 to prevent a decrease in the head temperature. In particular, the power transmission times that correspond to such dummy pulses are incorporated in the power transmission time table 121, which is also used for controlling the printing density during the printing operation. Accordingly, dummy pulses are applied to the heating elements 21 having printing density of "0" at the same time regular pulses are applied to the heating elements 21 having the printing densities greater than "0".

Thus, in cases in which the head temperature is low, the power transmission time that corresponds to zero printing density is set not as zero, but as a time that is not long enough to actually perform printing. Accordingly, a decrease in the head temperature can be prevented. Consequently, the desired printing density can be obtained immediately after the heating element resumes printing after the printing density continues to be zero for a while. Thus, the printing quality can be improved.

In addition, in cases in which the head temperature is not low, the power transmission time that corresponds to the zero printing density is set forth as 0. Accordingly, for example, as compared to a system in which the power is always transmitted to head elements whose printing density is "0" regardless of the temperature of the head, the excessive accumulation of heat in the thermal head 20 can be prevented. Consequently, unnecessary coloring can be prevented, so that the printing quality can be improved.

Moreover, the abovementioned power transmission time is applicable during the printing operation. Accordingly, as compared to a system in which, for example, power is transmitted to the head elements separately from the printing operation for the purpose of preventing a decrease in the temperature, there is no increase in the overall printing time. Such an effect can be obtained by the head temperature decrease prevention means of the abovementioned control part 100 using the power transmission time table 121.

Furthermore, in the power transmission time table 121, the power transmission time that corresponds to zero printing density is set at a longer time as the head temperature becomes lower. Accordingly, even though a decrease in the head temperature is considerable, the head temperature can be quickly elevated. Also, in cases in which a decrease in the head temperature is small, the excessive accumulation of heat in the thermal head 20 can be prevented.

Furthermore, the values of the temperatures, power transmission times, printing densities, and the like disclosed in the above description are merely examples, and the present invention is not limited to these values. Moreover, although a case of color printing is described in the above embodiment, the thermal printer of the present invention can also be applied to black and white printing.

Furthermore, in the thermal printer 1, the thermal head 20 and the thermistor 30 were described as separate components. However, a component in which both of the thermal head 20 and the thermistor 30 are integrated is also sometimes referred to as a "thermal head." However, as long as such an integrated thermal head contains parts that respectively correspond to the abovementioned "thermal head 20" and "thermistor 30." The present invention is also applicable to such integrate thermal head that contains both the thermal head 20 and the thermistor 30.

Figure 5:
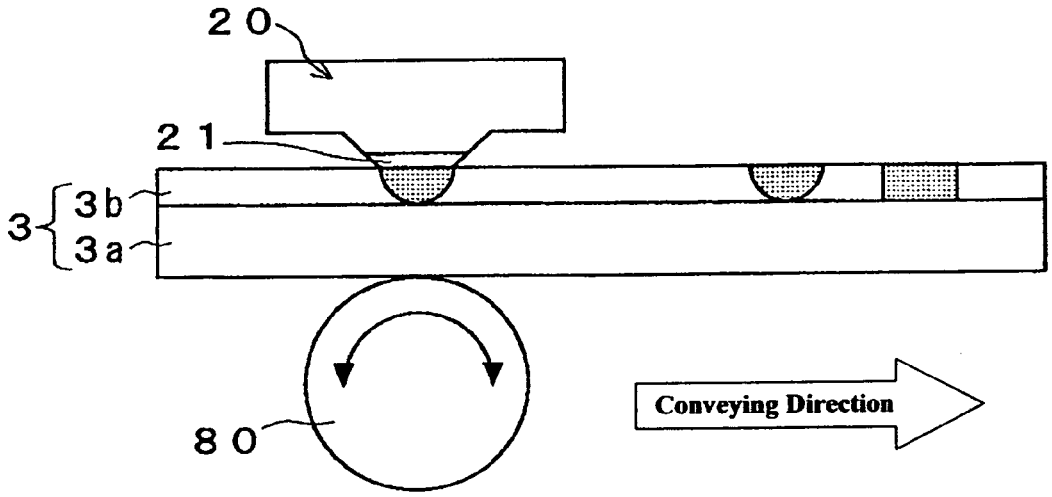
FIG. 5 is a schematic diagram illustrating a printing system in a thermal printer in accordance with another embodiment of the present invention.
Figure 6:
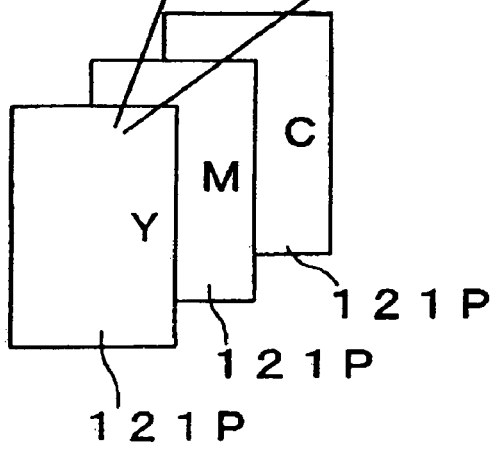
FIG. 6 is a schematic diagram illustrating a known thermal printer.
Figure 7:
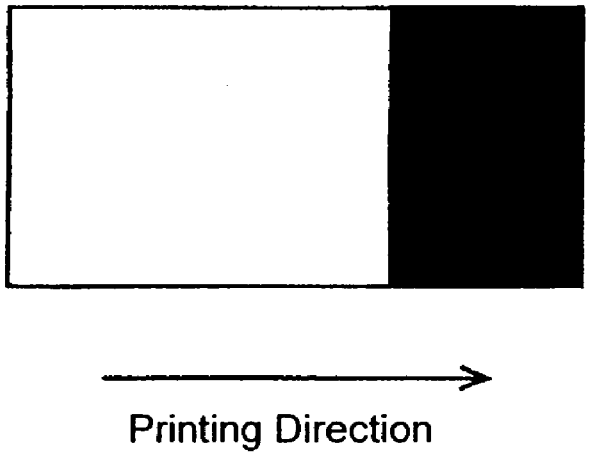
Figure 7 (a) PRIOR ART
FIG. 7 is a schematic diagram illustrating the problems encountered in the known thermal printer.
Figure 7:
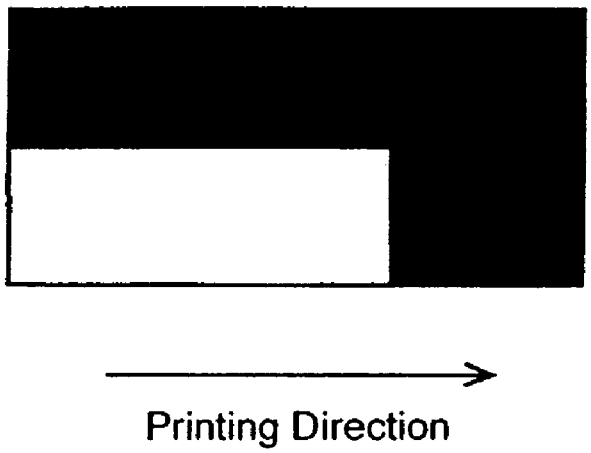
Figure 7 (b) PRIOR ART

Here, FIG. 5 shows a schematic diagram used to illustrate another printing system that utilizes the thermal printer 1. As is shown in FIG. 5, the thermal printer 1 can perform printing using a heat-sensitive paper 3 in which a substrate 3*a* and heat-sensitive layer 3*b* are laminated instead of an ink ribbon 40 (see FIG. 3) and image receiving paper 2 (see FIG. 3). In this case as well, the printing density can be adjusted in accordance with the temperature of the heating elements 21.

Furthermore, since the temperature control of the heating elements 21 can be accomplished by controlling the energy that is applied to these heating elements 21, it is also possible to control the supply of energy by controlling the voltage that is applied to the heating elements 21, instead of the power transmission time.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2005-007439. The entire disclosure of Japanese Patent Application No. 2005-007439 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A thermal printer adapted to perform printing on a paper based on printing density data input, the thermal printer comprising:

a thermal head having at least one heating element;

a temperature detector which is configured to detect a temperature of the thermal head; and a control part which is operatively connected to the thermal head and the temperature detector and configured to receive the printing density data and control an amount of energy to be supplied to the heating element based on the printing density data, wherein the control part stores therein a printing density-energy supply amount table which sets forth an amount of energy to be supplied to the heating element to perform printing with certain printing densities at certain head temperatures, the printing density-energy supply amount table setting forth that the amount of energy to be supplied is greater than zero at the printing density of zero if the head temperature is lower than a predetermined temperature, while the energy to be supplied to the heating element is zero at the printing density of zero if the head temperature is higher than the predetermined temperature.

2. The thermal printer according to claim 1, wherein the energy to be supplied to the heating element at the printing density of zero increases as the head temperature decreases when the head temperature is lower than the predetermined temperature.

3. The thermal printer according to claim 1, wherein the printing density-energy supply amount table sets forth power transmission times during which electric power should be supplied to the heating element to perform printing with certain printing densities at certain head temperatures, and the control part is configured to control the amount of energy to be supplied to the heating element by controlling the power transmission time to the heating element.

4. The thermal printer according to claim 1, wherein the thermal head has a plurality of heating elements, and the control part is configured to control the amount of energy to be supplied to each of the heating elements based on the printing density data.

5. The thermal printer according to claim 4, wherein the plurality of heating elements correspond to a plurality of colors to be printed.

6. A thermal printer adapted to perform printing on a paper based on printing density data input, the thermal printer comprising:

a thermal head having a plurality of heating elements, the plurality of heating elements corresponding to a plurality of colors to be printed;

a temperature detector which is configured to detect a temperature of the thermal head; and a control part which is operatively connected to the thermal head and the temperature detector and configured to receive the printing density data and control power transmission time during which electric power is supplied the heating element for each of the heating elements based on the printing density data, wherein the control part stores therein a printing density-power transmission time table which sets forth power transmission times necessary to perform printing with certain printing densities at certain head temperatures, the printing density-power transmission time table setting forth that the power transmission time is greater than zero at the printing density of zero if the head temperature is lower than a predetermined temperature, while the power transmission time is zero at the printing density of zero if the head temperature is higher than the predetermined temperature, the power transmission time increasing at the printing density of zero as the head temperature decreases when the head temperature is lower than the predetermined temperature.

* * * * *